US006691942B1

(12) United States Patent
Josefsson et al.

(10) Patent No.: US 6,691,942 B1
(45) Date of Patent: Feb. 17, 2004

(54) YARN FEEDING DEVICE

(75) Inventors: Paer Josefsson, Boras (SE); Alf Bengtsson, Fritsia (SE)

(73) Assignee: Iropa AG, Baar (CH)

( * ) Notice: Subject to any disclaimer, the term of this patent is extended or adjusted under 35 U.S.C. 154(b) by 0 days.

(21) Appl. No.: 10/070,320

(22) PCT Filed: Sep. 1, 2000

(86) PCT No.: PCT/EP00/08564

§ 371 (c)(1),
(2), (4) Date: Jul. 22, 2002

(87) PCT Pub. No.: WO01/17885

PCT Pub. Date: Mar. 15, 2001

(30) Foreign Application Priority Data

Sep. 2, 1999 (DE) ..... 199 41 889

(51) Int. Cl.[7] ..... B65H 51/20
(52) U.S. Cl. ..... 242/365.3; 139/452
(58) Field of Search ..... 242/365.3, 365.5, 242/366.2, 365; 139/452

(56) References Cited

U.S. PATENT DOCUMENTS 2,244,119 A * 6/1941 Samerdyke ..... 242/366.2
4,035,044 A * 7/1977 Miyazaki ..... 384/447
4,403,745 A * 9/1983 Tholander ..... 242/364.7
4,632,154 A * 12/1986 Maina ..... 139/452
4,747,549 A * 5/1988 Balzarotti ..... 242/365.3
5,520,226 A * 5/1996 Pedrini ..... 242/365.3
5,890,670 A * 4/1999 Zenoni et al. ..... 242/366.2
5,983,955 A 11/1999 Hellstroem
6,279,619 B1 8/2001 Halvarsson

FOREIGN PATENT DOCUMENTS

DE 198 50 782 A1 5/2000
WO WO 96/28594 9/1996
WO WO 99/14149 3/1999

* cited by examiner

*Primary Examiner*—Michael R. Mansen
(74) *Attorney, Agent, or Firm*—Flynn, Thiel, Boutell & Tanis, P.C.

(57) ABSTRACT

The invention relates to a yarn feeding device with a stationary storage drum and an adjustable yarn pitch. The yarn feeding device comprises a motor housing, a drive shaft of a winding element and a storage drum. Said storage drum consists of meshing finger-shaped cages. The finger-shaped advance cage has an advance bushing that is eccentric and skew with respect to the drive shaft. A backturn detent for the take-up element is mounted in said advance cage. The backturn detent is furthermore interposed between the finger-shaped advance cage and the drive shaft.

14 Claims, 1 Drawing Sheet

YARN FEEDING DEVICE

FIELD OF THE INVENTION

The invention relates to a yarn feeding device.

BACKGROUND OF THE INVENTION

Yarn feeding devices operating with adjustable yarn separation and a backturn detent for the winding element are known in practice by prior notorious use and e.g. disclosed in WO/A-99/14149. Such yarn feeding devices predominantly are used for processing special yarn materials, e.g. for supplying the weft yarn when weaving filtering or bossing fabric webs for paper or cardboard production. Due to the elasticity or rigidity of the yarn material or due to certain mechanical conditions a tendency of a backturning motion of the winding element occurs counter to the winding on direction when the winding element stops. This might result in the formation of loops or kinks in the yarn or might lead to overlaps between the yarn windings on the storage drum and finally in operation failures. The backturn detent is provided between the motor housing and the drive shaft or in the supporting bearing of the stationary rod cage and prevents this undesirable backturn motion of the winding element. The yarn separation, i.e. the intermediate distance between respective two adjacent yarn windings on the storage drum in such cases with delicate yarn material is an extremely important measure to properly control the yarn. As the magnitude of yarn separation (pitch) is not the same for all yarn qualities and yarn types but is dependent on each yarn type or each yarn material, respectively, and individually depends on different factors, the magnitude of the yarn separation has to be adjusted in order to achieve optimum conditions for the respective yarn being processed. The yarn separation results from an advance motion in a direction oriented to the withdrawal end of the storage drum, which advance motion is imparted on to the yarn windings on the storage drum. For that function it is a common principle to rotate by the drive shaft an eccentric and skew cylinder inside the advance rod cage. The advance rod cage of the stationary storage drum is supported rotatably on said cylinder. The rotation of said cylinder generates a wobbling motion of the advance rod cage. Thanks to the wobbling motion the rods of the advance rod cage first move outwardly beyond the rods of the supporting rod cage, simultaneously are moved forward relative to the winding on location of the yarn, and finally re-enter inwardly behind the rods of the support rod cage, reverse their motion direction and return to their home position. In order to vary the magnitude of the yarn separation either the radial plane of the maximum eccentricity is rotated about the axis of the drive shaft relative to the plane of the skew inclination of the cylinder to vary the phase offset between those two radial planes, or the magnitude of the skewness position is varied at a given phase offset between the two radial planes. In case of the first, technically simpler method, a bushing carrying the skew cylinder surface is rotated on an eccentric element which either is provided on the drive shaft or even is formed at the drive shaft. In this case, for adjustments the bushing is held against rotation from outside and the drive shaft is rotated inside with the help of the winding element and in one or the other rotational directions. However, the mentioned backturn there only allows a rotation of the drive shaft in one direction of rotation, namely in the winding on direction. For this reason an adjustment of the yarn separation in the locked direction of rotation cannot be carried out by simply rotating the driving shaft by means of the winding element.

It is an object of the invention to provide a yarn feeding device of the kind as disclosed at the beginning at which the yarn separation despite the presence of a backturn detent can be increased or decreased by simply rotating the driving shaft.

As intended, the backturn detent prevents the undesired backturning motion of the winding element since the driving shaft is blocked in backturning direction by the backturn detent and the advance rod cage inside the stationary storage drum. According to this the desired safety effect of the backturn detent is reliably achieved. As for the adjustment of the yarn separation the advance rod cage has to be held while the drive shaft is rotated in one or the other direction of rotation. The locking action of the backturn detent in backturn rotational direction optionally even can be used to provide the relative rotation between the planes of the skew inclination position and the eccentricity. For that reason it is comfortably possible to increase or decrease the yarn separation despite the action of the backturn detent and only by rotating the drive shaft, e.g. by hand, and with the help of the winding element in the respectively required direction. Extremely comfortable and quick adjustments even can be carried out in the blocked direction of rotation without an auxiliary tool just with the help of the backturn detent.

The backturn detent can be provided in the advance support in a structurally simple and space saving manner.

As relative rotational movements between the drive shaft and the stationary advance rod cage occur between the inner race and the outer race of a usual ball bearing or between the bearing surfaces of a plain bearing, it is expedient to provide the backturn detent between the races or between the bearing surfaces, respectively. In this case expediently a conventionally available bearing just containing the backturn detent can be used. The backturn detent can be equipped by locking elements, similar to the free wheel assembly of a bicycle driving hub, which locking elements engage automatically only in case of or prior to the not desired rotational motion. As a consequence the backturn detent can be made as a rotational freewheel device locking automatically in one rotational direction or as a overtaking rotational clutch locking automatically in one rotational direction. Alternatively, the backturn detent may be located between the advance bearing and the drive shaft such that the advance bearing is supported by the backturn detent on the drive shaft or the adjustable element of the yarn separation mechanism respectively.

As a further alternative the backturn detent may be provided parallel to the advance bearing and at a side of the latter. The locking effect is imparted between the bearing races or the bearing surfaces, respectively, or directly between the element and the advance rod cage, which element is provided for rotational adjustment on the drive shaft.

For a comfortable and gradual adjustment of the yarn separation the axis of eccentricity and the axis of the skew inclination are adjustable in relation to each other and/or relative to the axis of the drive shaft.

The axis of the eccentricity and the skew inclination axis are adjusted in relation to each other in rotational direction of the drive shaft in each sense of rotation, in order to allow to use a rotational motion of the drive shaft for the adjustment, which rotational motion may be imparted manually. In this it is expedient to integrate the axis of eccentricity into the drive shaft and to constitute the axis of the skew inclination by a separate element mounted on the drive shaft for its rotational adjustments.

In a plain bearing even the bearing surfaces could be located skew or eccentrically with respect to the axis of the drive shaft. In this case the inner bearing sleeve is constituting the element necessary for the adjustment of the yarn separation, which element they can be rotated relative to the drive shaft.

The phase offset between the skew inclination position and the eccentricity is varied by relative rotational adjustments such that an increase or decrease or even a complete nullification of the yarn separation results.

In a structurally simple way a bushing is provided at a carrying surface of the drive shaft such that the bushing can be rotated on the drive shaft and can be fixed in the respective desired rotational position. The bushing constitutes an element of the yarn separation adjusting yarn mechanism which element can be adjusted by rotation. In this case either the carrying surface of the drive shaft or the counterstay surface of the bushing may be formed eccentrically. The respective other of both surfaces in this case then is located in a skew inclined position.

Expediently, the advance bearing is provided on the bushing without the possibility to be rotated. Furthermore, a rotational locking socket is provided for engagement of an adjustment tool in order to hold the bushing in case of an adjustment of the yarn separation and when the drive shaft is rotated relative to the bushing by means of the winding element.

An adjustable friction clutch between the bushing and the drive shaft allows a comfortable and simple handling. The friction connection of the friction clutch only needs to be strong enough so that the bushing reliably is taken with in case of normal rotation of the drive shaft, and just so strong that the backturn locking force is unable to overcome the friction force of the friction clutch.

At least two axially spaced apart roller bearings or plain bearings are provided to achieve a stable support of the advance rod cage. The backturn detent, however, only needs to be provided in one of both bearings. If desired, however, each bearing of the advance support could be equipped by backturn detents.

A simple handling of the yarn feeding device in case of an adjustment of the yarn separation is possible, if the adjustment tool is constituted by an on-board pin adjustable in the front end of the storage drum between an engaging position in the rotation locking socket and a passive position. In case that the pin is pre-loaded by a spring, e.g. towards its passive position, an adjustment process can be carried out easily, because the pin only need to be pressed counter to the spring force into its engaging position, before the drive shaft is rotated accordingly. Later, by spring force, the pin automatically returns into its passive position.

In order to avoid an excessive adjustment expediently a stop arrangement ought to be provided for limiting the relative rotational adjustment stroke of the bushing on the drive shaft.

BRIEF DESCRIPTION OF THE DRAWINGS

An embodiment of the invention will be described with the help of the drawing. In the drawing.

DETAILED DESCRIPTION

Figure 1:
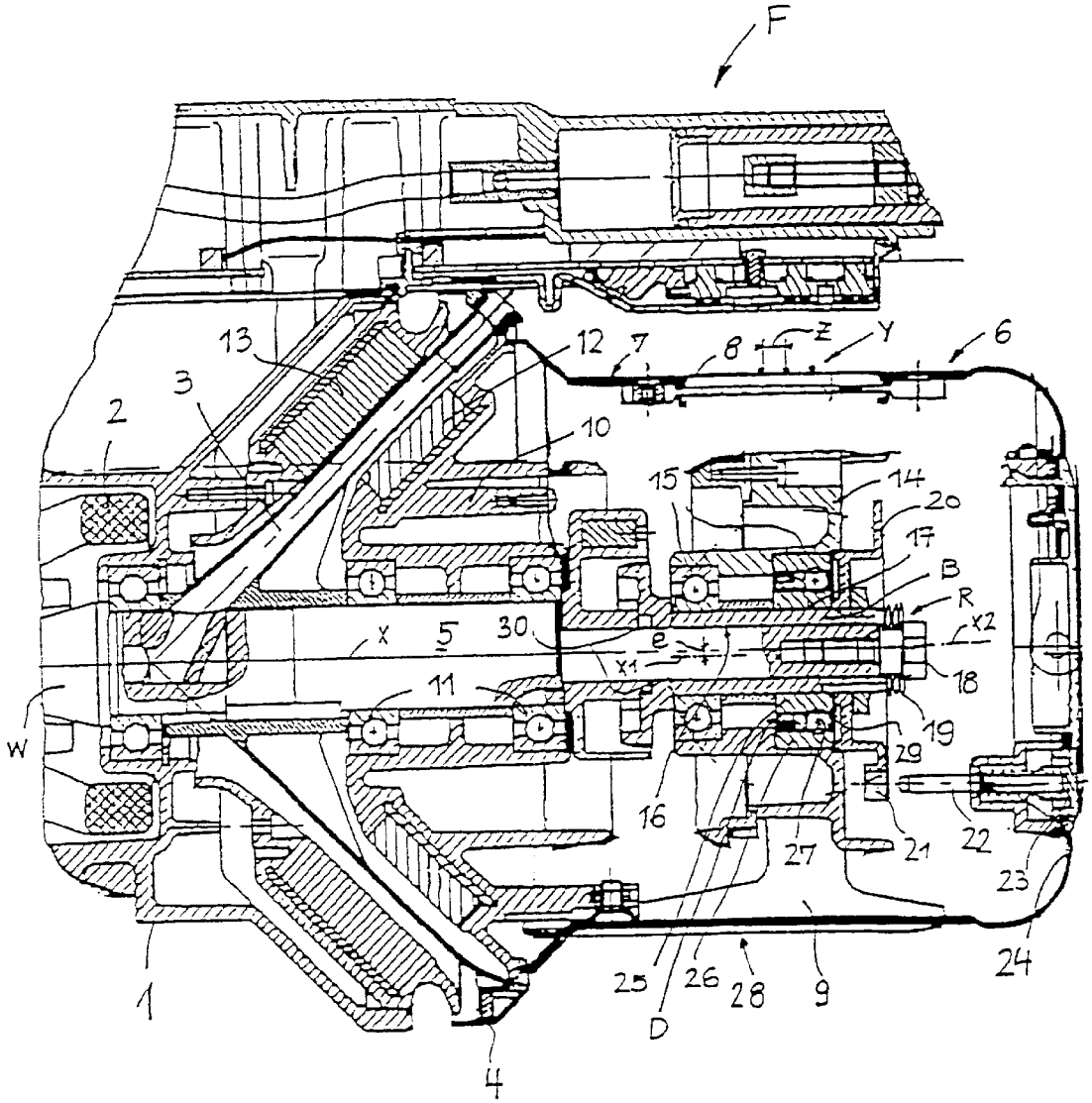
FIG. 1 is a longitudinal axial section of components of a yarn feeding device, the yarn feeding device including an adjustable yarn separation and backturn detent.

A yarn feeding device F in FIG. 1 has a motor housing 1 containing an electromotor 2 driving a drive shaft W about an axis X in one selected direction of rotation. A winding element 3 is provided at drive shaft W, e.g. a winding tube, terminating outside of motor housing 1 and extending obliquely outwards from hollow drive shaft W. Winding element 3 in this case is incorporated into a so-called winding disk 4 which is carried by drive shaft W and is located between motor housing 1 and a storage drum 6 which storage drum is supported via the drive shaft W at motor housing 1. Drive shaft W functions as the carrier of storage drum 6 and has, for this purpose, a coaxial extension 5.

Storage drum 6 is combined from two interengaging rod cages, namely of a supporting rod cage 7 having axial rods 8 spaced apart in circumferential direction, and an advance rod cage 28 having axial rods 9 respectively provided in the interspaces between rods 8. Support rod cage 7 has a stationary front end 24 and is located on a hub 10 which is supported rotatably on the extension 5 by a support bearing 11 (e.g. two roller bearings) coaxially with axis X of drive shaft W.

To hinder storage drum 6 against rotation with the rotating drive shaft W, co-operating permanent magnets 12, 13, as well known, are provided in the motor housing 1 and in hub 10, respectively (stationary storage drum).

The rods 9 of the advance rod cage 28 are provided at a common hub 14. The hub 14 is supported by a bushing B rotatably seated on drive shaft W in an advance bearing 15 provided eccentrically and skew or inclined relative to the axis X of drive shaft W. The bushing B is seated on a support surface 16 which is cylindrical and located eccentrically relative to the axis X. Cylindrical support surface 16 is formed on extension 5 or is constituted by a not shown member provided on extension 5. An eccenter axis X1 of support surface 16 is distanced by a measure e from axis X. Another cylindrical support surface 17 is formed at the periphery of bushing B and is skew and inclined relative to axes X and X1 (indicated by the dash dotted inclination axis X2).

In the drawing the eccenter axis X1 and the inclined axis X2, for illustration purposes only, are shown in the drawing plane. In order to achieve the yarn separation Z between the yarn windings of the yarn Y wound by winding element 3 onto storage drum 6, however, a phase offset in rotational direction of drive shaft W has to be provided between the plane containing the axes X, X1 and the plane containing the inclination axis X2. In order to increase, decrease or completely nullify the yarn separation Z the above-mentioned phase offset between the inclination axis X2 and the eccenter X1 is to be varied in the respective direction of rotation. A friction clutch R is provided between the bushing B and the drive shaft W, e.g. in the form of a spring package 19 loading the free front end of the bushing B which spring package 19 is pre-loaded by a tensioning screw 18 inserted into the set back free end of the drive shaft W. The spring package 19 couples the bushing B with a predetermined rotation resistance with the drive shaft W.

Furthermore, a rotation-locking socket 21 is provided in the advance bearing 15, e.g. at a ring flange 20 which may, e.g., be coupled to the bushing B in rotational direction.

An on-board adjustment tool 22 is located in the stationary front end 24 of storage drum 6. The adjustment tool 22 has the form of a pin which can be brought into an engaging position into rotation locking socket 21 counter to spring force from the shown passive position. In the shown embodiment the advance bearing 15 consists of two axially spaced apart roller bearings. Of the roller bearings the roller bearing 29 facing towards the free end of the drive shaft W is equipped with a backturn detent D. The roller bearing 29 comprises an inner race 25 and an outer race 26 and roller bodies 27 located therebetween. The backturn detent D is functionally integrated between the inner race and the outer race 25, 26. Alternatively, the advance bearing 15 instead could include one or two plain bearings having co-operating slide surfaces.

Even though the detail structure of the backturn detent D is not shown, it is to be noted that it is a freely available rotational freewheel or an overtake rotational clutch (sprag clutch) containing locking elements which automatically move into a locking engagement when a rotation tends to occur in the undesired rotational direction. In the shown embodiment the backturn detent D is integrated into the advance bearing 15. It is, however, possible to incorporate the backturn detent into the roller bearing shown in FIG. 1 on the left side, or even to equip both roller bearings with a respective backturn detent. Furthermore, it is possible, to provide the backturn detent D between the inner race 25 and the bushing B, or to provide it parallel to the respective bearing and at the side of the same.

Finally, a stop assembly 30 is provided between the bushing B and the drive shaft W for limiting the rotational stroke of the bushing B relative to drive shaft W.

In operation of the yarn feeding device F the rotating winding element 3 is supplying the yarn Y onto the storage drum 6. Due to the skew and eccentric support surface 17 of the bushing B rotating with the drive shaft W the inner race 25 is carrying out a rotating wobbling motion. As the stationary support rod cage 7 is hindered by the co-operating permanent magnets 12, 13 to rotate with the drive shaft, also the advance rod cage 28 is hindered by the mutually interengaging rods 8 and 9 from rotating with the drive shaft.

Between the inner race 25 and the outer race 26 a rotational motion can take place in only one direction of rotation. At the same time tilting motions derived from the wobbling motion of the inner race 25 are transmitted into the rods 9 which effect the advance motion of the yarn windings and by this produces the adjusted yarn separation Z.

If the electromotor 2 is stopped a tendency of a backturn motion of the winding element 3 counter to the former winding on direction can occur, e.g. due to tension in the yarn Y. However, the backturn detent D then is coupling the inner race 25 to the outer race 26 and blocks the drive shaft W in this undesired direction of rotation against the hub 14 of the advance rod cage 28. A backturn motion is prevented.

In case that the yarn separation Z is to be varied, i.e. is to be increased, decreased or completely to be nullified, first the electromotor 2 is stopped. Then the winding disk 4 is rotated manually and at the same time a frontally located button is pressed to insert the tool 22 into the rotation locking socket 21. As a consequence of the friction connection of the friction clutch R the drive shaft W or the winding disk 4, respectively, can no longer be rotated freely. As soon as the friction resistance of the friction clutch R is overcome, however, the support surface 16 can be rotated with the drive shaft W within the bushing B, while the bushing B is locked by the tool 22. Within the rotational stroke determined by the stopping assembly 30 the respective desired adjustment of the yarn separation Z can be carried out. As soon as the tool 22 is set free, or the button is released which is provided in the front side 24 to actuate the tool 22, respectively, the return spring moves the tool 22 back into the shown passive position, preferably assisted by a slight manual rotational movement of the winding disk 4 in one or the other direction of rotation. Then the yarn feeding device F again is ready to operate.

As an alternative for the shown adjustment tool 22 a separate adjustment tool could be inserted from outside between the interengaging rods 8, 9 or even through one of the rods into a then modified rotation locking socket 21 to allow to hold the bushing B against rotation. Basically, the backturn detent D is active in one direction of rotation of the drive shaft W and parallel to the adjustment tool 22. This has the effect that also the backturn detent D supports the bushing B in this direction of rotation against rotation at advance rod cage 28 and, in turn, at the storage drum 6. In case that a desired adjustment of the yarn separation Z needs only a rotational movement of the drive shaft W in the rotational direction locked by the backturn detent D, then adjustment tool 22 does not need to be actuated. Such adjustments can be carried out by using the locking function of the backturn detent D instead.

In case that the operational direction of rotation of the winding element 3 is to be reversed, either the roller bearing 29 containing the backturn detent D has to be reversed, or a respective roller bearing 29 is to be mounted containing a backturn detent acting in the opposite direction of rotation.

What is claimed is:

1. Yarn feeding device comprising a stationary storage drum and operating with an adjustable yarn separation, having a motor housing for supporting a drive shaft of a winding element and forming a carrier for said storage drum, said storage drum comprising two interengaging rod cages, one of which being a support rod cage comprising a support bearing coaxial to said drive shaft, the other of which being an advance rod cage comprising an advance bearing situated eccentrically and skewed relative to said drive shaft, and further comprising a backturn detent for said winding element, wherein said backturn detent is located between said advance rod cage and said drive shaft.

2. Yarn feeding device as in claim 1, wherein said backturn detent is provided in said advance bearing.

3. Yarn feeding device as in claim 1, wherein said advance bearing includes at least one roller bearing having an outer race and an inner race, and that said backturn detent is provided between the outer race and the inner race or between the bearing surfaces, respectively.

4. Yarn feeding device as in claim 1, wherein said backturn detent is located between the advance bearing and the drive shaft.

5. Yarn feeding device as in claim 1, wherein said backturn detent is located parallel to said advance bearing and at the side of the same.

6. Yarn feeding device as in claim 1, wherein said backturn detent is a rotational freewheel automatically locking in one direction of rotation, or is an overtake rotational clutch or sprag clutch.

7. Yarn feeding device as in claim 1, wherein the skewed position and the eccentricity of said advance bearing are defined by an eccenter axis parallel to an axis of said drive shaft and by a skew axis which is inclined relative to said axis of said drive shaft, and that the eccenter axis and said skew axis are provided adjustably relative to each other and/or relative to said axis of said drive shaft, respectively.

8. Yarn feeding device as in claim 7, wherein said eccenter axis and said skew axis are provided adjustably relative to each other in the rotational direction of said drive shaft and in each direction of rotation.

9. Yarn feeding device as in claim 1, wherein a bushing is provided on a first skewed or eccentric support surface of said drive shaft, said bushing comprising at its periphery a second eccentric or skewed support surface for an inner race of said advance bearing, and that said bushing is provided rotatably into different rotation positions on said drive shaft and is fixable in said rotation positions.

10. Yarn feeding device as in claim 9, wherein a rotation locking socket for an adjustment tool is provided in the vicinity of said advance bearing or said bushing, respectively, to temporarily lock said bushing in relation to the rotating drive shaft for carrying out adjustments of said yarn separation.

11. Yarn feeding device as in claim 10, wherein said adjustment tool is constituted by an on-board member which is adjustable within a stationary front end of said storage drum between a passive position and an engagement position into said rotation locking socket, and that said member preferably is a pin which can be pushed inwardly counter to a return spring load.

12. Yarn feeding device as in claim 10, wherein a stopping assembly is located between said bushing and said drive shaft for limiting a relative adjustment stroke of said bushing.

13. Yarn feeding device as in claim 9, wherein said bushing is coupled to said drive shaft via an adjustable friction clutch.

14. Yard feeding device as in claim 1, wherein said advance bearing comprises two axially spaced apart roller bearings or plain bearings, and that said backturn detent is provided in only one of said roller bearings or plain bearings, preferably at the bearing situated close to a bushing end which faces away from said motor housing.

* * * * *